United States Patent [19]

Hashish

[11] Patent Number: 4,698,939

[45] Date of Patent: Oct. 13, 1987

[54] TWO STAGE WATERJET AND ABRASIVE JET CATCHER

[75] Inventor: Mohammed A. Hashish, Kent, Wash.

[73] Assignee: Flow System, Inc., Kent, Wash.

[21] Appl. No.: 796,424

[22] Filed: Nov. 8, 1985

[51] Int. Cl.[4] ..... B24C 9/00

[52] U.S. Cl. ..... 51/410; 51/424; 51/321; 239/103; 181/265; 83/53; 83/177

[58] Field of Search ..... 51/424, 410, 439, 321, 51/272; 83/53, 177; 239/103, 104, 120; 181/265

[56] References Cited

U.S. PATENT DOCUMENTS 3,150,467 9/1964 Umbricht et al. ..... 51/321

*Primary Examiner*—Frederick R. Schmidt
*Assistant Examiner*—Robert A. Rose
*Attorney, Agent, or Firm*—Romney Golant Martin Seldon & Ashen

[57] ABSTRACT

A catcher for use in liquid and abrasive-laden liquid jet cutting apparatus that includes a separate fluid-filled chamber for reducing noise. The catcher also provides for increasing the speed of return flow to reduce the length of fluid required to absorb the kinetic energy of a jet.

12 Claims, 4 Drawing Figures

TWO STAGE WATERJET AND ABRASIVE JET CATCHER

FIELD OF INVENTION

This invention pertains to catchers for high pressure waterjets and abrasive laden waterjets.

BACKGROUND OF INVENTION

Waterjet cutters have been in use for the last decade to cut a wide variety of materials. Such a cutter commonly utilizes a source of high pressure liquid such as a hydraulic intensifier, a conduit system and a nozzle. Such a system is described in U.S. Pat. No. 4,435,902. One element of such a device is a catcher to absorb the energy of the cutting after the work is done. A typical catcher is a tube filled with a liquid.

Entraining abrasive particles in ultra-high pressure (over 20,000 psi.) waterjets has vastly improved cutting performance. Though still in the development stages, the abrasive-waterjet cutting techinque has already displayed its advantages over conventional methods in several special applications. It is now possible to effectively cut many materials that could not be cut with waterjets alone, including metals, ceramics, glass, etc.

To develop the market potential of this technique, it is necessary to reduce or eliminate a few critical limitations which prevent it from being widely adopted by the industry. One of the most severe limitations is lack of equipment portability. Other limitations include the lack of an efficient system to catch water and spent abrasives, and the high noise level associated with the breakup of the abrasive-waterjet stream.

Abrasive particles are highly destructive, even after cutting through hard materials. Currently, the energy of the abrasive-waterjet is dissipated in a water tank at least 2 feet deep. Shallower vessels have proved ineffective, because a stationary abrasive-waterjet can easily cut through 0.25" steel plate at the bottom of a 15" water column. Thus, an X-Y table requires a tank large enough to cover the maximum cutting area. The bulky tank restricts maneuverability, which is a prerequisite for robotic and many factory applications. Further, the action of the abrasive-water jet churns the water and abrasives in the catcher/tank, increasing spillage. Also, frequent cleaning of the catcher/tank is necessary to remove used abrasives and residues that accumulate during cutting. Aside from these problems, the tank itself serves as a reesonator that radiates noise. It is extremely difficult to incorporate an effective noise suppression device into such a system.

The following criterion have been established to describe a catcher for waterjets and abrasive-laden waterjets:

1. Adequate protection to the wall and bottom of the catcher
2. Minimal size and weight for portability and maneuverability
3. Minimal vibration to facilitate accurate cutting performance
4. Facilitate discharge of water and abrasives to a hopper for ease of removal and clean up
5. An effective noise suppression device to protect operators An attempt has been made to use a 24" long tube catcher filled with water alone. However, this length may be unacceptable for many factory applications, especially robotic operations, and the water column is inadequate unless a carbide plug is used to protect the bottom of the catcher. In cutting operations the deflection of the abrasive-waterjet causes severe damage to the tube wall. The longer the catcher, the more vulnerable is the side wall. A wear-resistant liner such as a carbide sleeve for the tube catcher inner wall would be quite expensive.

SUMMARY OF THE INVENTION

The invention provides a simple catcher for waterjets and abrasive-laden waterjets that both reduces noise and slows the jet and which is characterized by a relatively long life.

The catcher includes several parts. First, an entry section minimizes noise escape and vibration. Second, a damping section utilizes the flow of liquids to reduce wear on the catcher and minimizes the size of the catcher, next, a noise reducing section markedly reduces the noise generated by the jet, and finally, an exit section facilitates discharge of water and abrasives.

Figure 1:
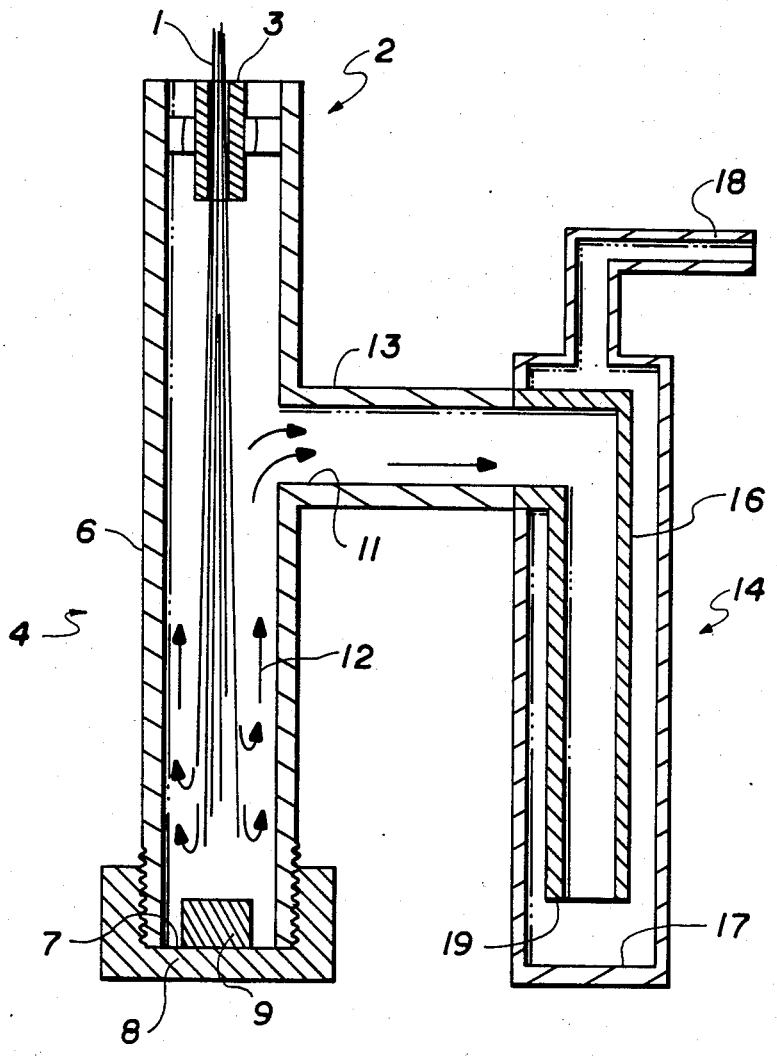
FIG. 1 is a section front elevation view of the invention.

DETAILED DESCRIPTION OF THE INVENTION:

FIG. 1 is a section elevation view of the invention. A high pressure waterjet or abrasive waterjet from a jet cutting apparatus such as described in our U.S. Pat. No. 4,216,906 enters the entry section 2 of the invention. Entry Section 2 includes an inlet 3 of reduced diameter which allows passage of jet 1 but retards emission of sound. The jet then proceeds into the damping section 4 of the invention. When jet 1 enters inlet 3 air is also sucked into the catcher due to the aspiration principle. Damping section 4 includes a fluid filled chamber 6 which is preferably cylindrical in cross section. The end 7 of section opposite inlet 3 is closed by a cap 8. Cap 8 is protected by a plug 9 of wear-resistant material such as a metallic or non-metallic carbide (WC, SiC or ceramic ($AL_2O_3$)). As jet 1 enters the fluid in chamber 6 it flows toward plug 9 until its kinetic energy is spent. The only outlet from chamber 4 is an outlet 11 placed between inlet 3 and plug 9 and preferably closer to inlet 3. No outlet from inlet 3 is possible due to entrance of fluid jet 1 and asperated air. The spent fluid is thus forced to flow upward toward outlet 11 in opposition to jet 1. This return flow is indicated by arrows 12. The return flow aids in absorbing the kinetic energy of jet 1. Upon exit from damping section 4 fluid flow proceeds down a passage 13 into the noise reducing section 14 of the invention. The fluid flow at this point includes liquid, air and solid particles. Section 14 is preferably a hollow cylinder with a inlet tube 16 extending nearly to one end 17 and an outlet section 18 at the other end. The dimensions of chamber 14 are chosen to maximize sound absorption. In operation, section 14 is filled with fluid with inlet tube 13 outlet 19 always below liquid level. The exiting liquid and air must thus pass through liquid which further reduces noise escaping through the outlet section 18. Fluid and air finally flow through outlet section 18 to a hopper (not shown) to allow separation of fluid, abrasive and air.

Figure 2:
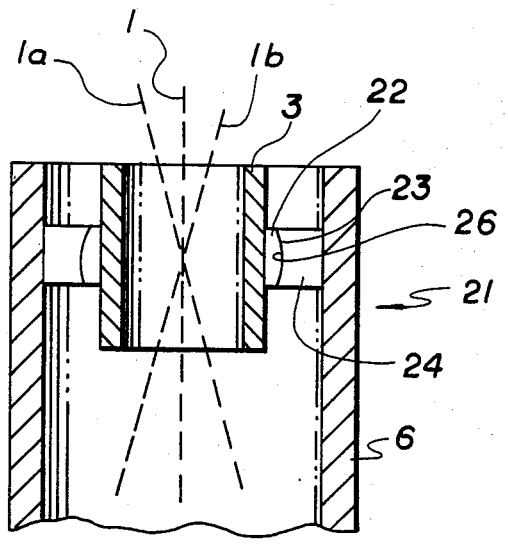
FIG. 2 is a section front elevation view of the entry section of the FIG. 1 embodiment.

FIG. 2 is a detail section elevation view of the entry section of the FIG. 1 embodiment. It is often the case that 1 the path of a water jet (not shown) is displaced from the vertical into positions 1*a* or 1*b*. This deflection is more noticeable when cutting thick materials and is inherent to the cutting process. Also, this displacement may be due to a misaligned jewel in the jet-forming nozzle or an off center jet-forming orifice in the jewel. This could result in collision of jet 1 with entry inlet 3 resulting in erosion of inlet 3 and its ultimate destruction. To allow for this possibility, inlet 3 is provided with alignment means 21. Alignment means 21 in this embodiment includes a round ring 22 with a spherical outer surface 23 attached to entry inlet 3 and an annulus 24 with a mating surface 26. Alignment means 21 thus allows adjustment of the entry section to allow for offset jets. Alternative means of alignment would be apparent to a person skilled in catcher construction.

Figure 3:
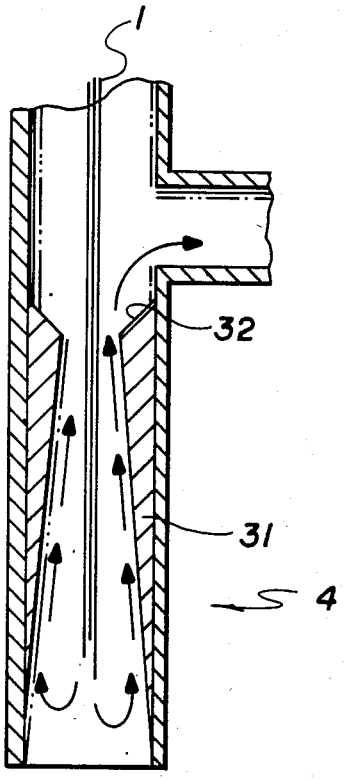
FIG. 3 is a section front elevation view of a second embodiment of the damping section of the invention.

FIG. 3 is a section elevation view of a second embodiment of the invention. This embodiment is identical to the FIG. 1 embodiment except for the addition of a converging diverging surface 31 to the interior of damping section 4. The entry, noise reduction and exit section (not shown) are identical to the FIG. 1 embodiment. Surface 31 is preferably constructed of a wear resistant material such as a metallic carbide. The return flow 12 is forced to increase its velocity in the vicinity of the throat 32 of surface 31. The increased velocity return flow acts to brake jet 1's velocity and absorb energy in less space than in the FIG. 1 embodiment. This allows damping chamber 4 to be made shorter than the FIG. 1 embodiment. A shorter catcher is particularly useful for mobile cutter applications.

Figure 4:
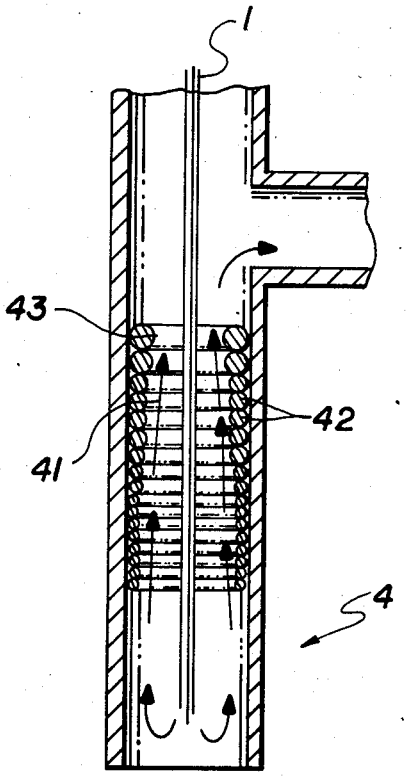
FIG. 4 is a section front elevation view of a third embodiment of the damping section of the invention.

FIG. 4 is a section elevation view of a third embodiment of the damping section of the catcher. In this embodiment the parts and function are identical to the FIG. 3 embodiment except that surface 41 is constructed from a plurality of rings 42. The rings have different inside diameters to form a throat area 43 analogous to area 32 in FIG. 3. Rings 42 may be metallic in a water jet catcher or could be ceramic or a metallic carbide if the jet is abrasive laden. Rings 42 are cheaper to fabricate than a carbide liner.

The embodiments shown are exemplary only the invention being defined solely by the attached claims.

I claim:

1. A catcher for use with waterjet and abrasive-laden waterjet cutting apparatus comprising:

entry means positioned in the path of the jet for accepting the cutting jet;

dampening means attached to said entry means for absorbing the kinetic energy of the accepted jet, said dampening means including means for producing a counterflow of fluid in opposition to the accepted jet, and a counterflowguiding surface which converges in the direction of counterflow for increasing the velocity of the counterflowing fluid;

sound absorption means attached to said dampening means and further along the path of fluid from said dampening means for absorbing sound; and exit means attached to said sound absorption means for removing fluid and particulate matter from the catcher.

2. A catcher as in claim 1 wherein said sound absorption means is further comprising:

a chamber fillable to a predetermined level with a fluid;

an inlet to said chamber so configured as to conduct counterflowing fluid from the dampening means into said chamber below the fluid level; and an exit from said chamber for permitting the egress of excess fluid.

3. A catcher as in claim 2 wherein said chamber is cylindrical.

4. A catcher as in claim 1, wherein said entry means is a tube having a smaller diameter than said damping means.

5. A catcher as in claim 4 wherein said entry means is adjustable in inclination to allow alignment with a jet.

6. A catcher as in claim 1 including a surface diverging in the direction of counterflow and joining said converging surface to form a throat which is closer to said entry means than to said counterflow-producing means.

7. A catcher as in claim 1 wherein said converging surface further comprises the interior surface of a plurality of rings in said damping means.

8. A catcher as in claim 7 wherein said rings all have a similar outside diameter.

9. A catcher as in claim 8 wherein the inside diameter of the first ring along the path of a jet is smaller than the inside diameter of the last ring.

10. A catcher for use with waterjet and abrasiveladen waterjet cutting systems comprising:

first chamber-defining means having an inlet end for receiving an axially directed cutting jet, and a distal end spaced from the inlet end in the general direction of jet travel;

passage-defining means in fluid communication with the first chamber interjacent the inlet and distal ends thereof for permitting the egress of spent jet fluid from the first chamber;

the first chamber having walls in at least a portion of the region between the distal end and the passage-defining means which converge in the direction of counterflow to increase the velocity of fluid counterflowing from the distal end towards the inlet end of the first chamber; and a plurality of ring-like members having inside diameters which generally decrease in the direction of fluid counterflow and forming the converging chamber walls.

11. A catcher for use with waterjet and abrasiveladen waterjet cutting systems comprising:

first chamber-defining means having an inlet end for receiving an axially directed cutting jet, and a distal end spaced from the inlet end in the general direction of jet travel; passage-defining means in fluid communication with the first chamber interjacent the inlet and distal ends thereof for permitting the egress of spent jet fluid from the first chamber;

the first chamber being shaped in at least a portion of the region between the distal end and the passage-defining means to increase the velocity of fluid counterflowing from the distal end towards the inlet end of the first chamber;

the inlet end of the first chamber-defining means having an aperture;

conduit means mounted within the aperture and in fluid communication with the first chamber at the inlet end for receiving the jet into the first chamber; and mounting means for mounting the conduit means within the aperture for self aligning movement in response to the force exerted by the jet on the conduit means when misaligned therewith.

12. A catcher for use with waterjet and abrasive-laden waterjet cutting systems comprising:

a chamber-defining body having an aperture at an inlet end thereof;

conduit means mounted within the aperture and in fluid communication with the chamber at the inlet end for receiving the jet into the chamber; and mounting means for mounting the conduit means within the aperture for self-aligning movement in response to the force exerted by the jet on the conduit means when the conduit means and the jet are misaligned.

* * * * *